United States Patent [19]

Wilkinson, Sr.

[11] 4,180,200

[45] Dec. 25, 1979

[54] LOCKABLE TRAY

[75] Inventor: James R. Wilkinson, Sr., Abingdon, Md.

[73] Assignee: Container Corporation of America, Chicago, Ill.

[21] Appl. No.: 965,032

[22] Filed: Nov. 30, 1978

[51] Int. Cl.[2] ..... B65D 5/22

[52] U.S. Cl. ..... 229/32; 229/34 HW; 229/34 A

[58] Field of Search ..... 229/32, 34 R, 34 HW, 229/34 A

[56] References Cited

U.S. PATENT DOCUMENTS

| | | | |
|---|---|---|---|
| 978,569 | 12/1910 | Elkin | 229/34 HW |
| 1,492,951 | 5/1924 | Auerbach | 229/34 HW X |
| 2,065,004 | 12/1936 | Guyer | 229/34 HW X |
| 2,118,821 | 5/1938 | Ringler | 229/34 R X |
| 2,163,117 | 6/1939 | Evans et al. | 229/34 HW |
| 2,295,141 | 9/1942 | Van Wingen | 229/34 HW |
| 2,326,926 | 8/1943 | Bureau et al. | 229/34 A |
| 2,373,730 | 4/1945 | Williamson et al. | 229/34 A |
| 3,246,830 | 4/1966 | Smith | 229/32 |

*Primary Examiner*—Davis T. Moorhead

[57] ABSTRACT

A tray formed from paperboard, or the like, has inner and outer end walls and flanged side walls. Locking tabs extending from the inner end walls lock said walls to the bottom while locking tabs hinged to the side walls lock the same to the end walls.

2 Claims, 3 Drawing Figures

LOCKABLE TRAY

BACKGROUND OF THE INVENTION

1. Field of the Invention

This invention relates to trays which may be formed from a cut and scored paperboard blank to provide double thickness end and side walls maintained in locking engagement to provide stacking strength to the trays.

2. The Prior Art

U.S. Pat. to Smith, No. 3,246,830, discloses a tray with flanged walls, but Smith is distinguishable from the present invention in that the present invention provides end walls of double thickness and flanged side walls, the latter having locking tabs extending therefrom locked in slots extending from hand receiving openings in the end walls.

SUMMARY OF THE INVENTION

A tray is formed from a cut and scored blank of paperboard and includes a rectangular bottom with upstanding opposed side and end walls. The end walls have inner panels which are folded against the outer panels and locked to the bottom. The side walls have rim flanges foldable with respect thereto into position along the outer face of the side walls. The rim flanges have locking tabs extending therefrom and in locking engagement with locking slots in the end walls.

THE DRAWING

Figure 1:
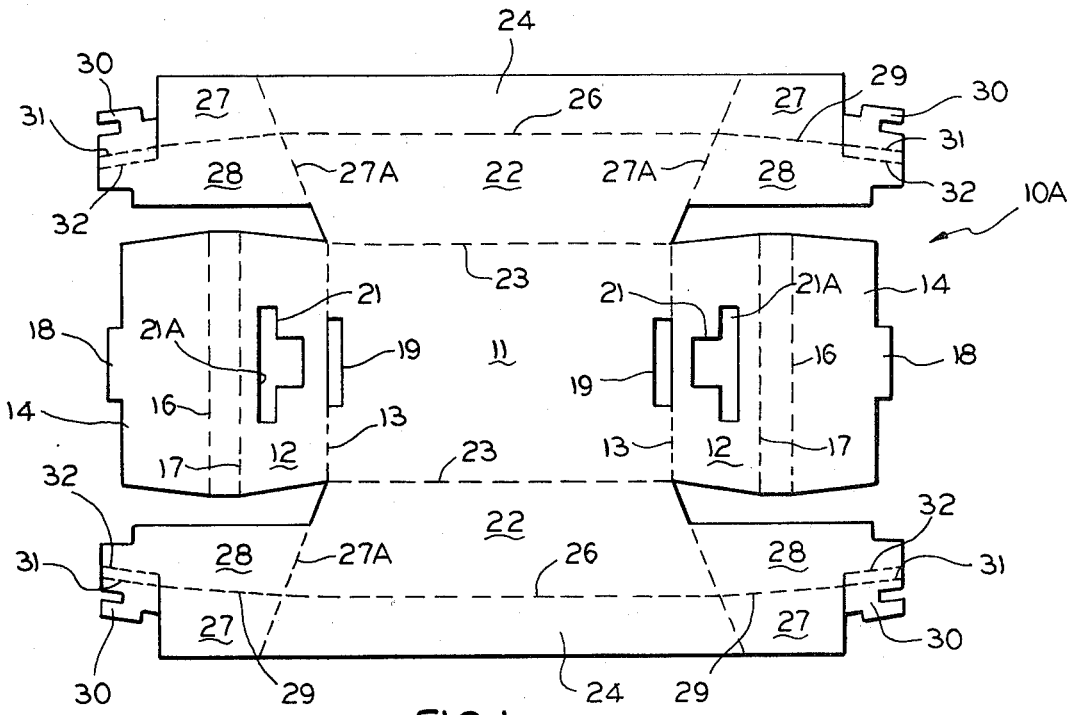
FIG. 1 is a plan view of a cut and scored blank for forming a tray according to the present invention.
Figure 2:
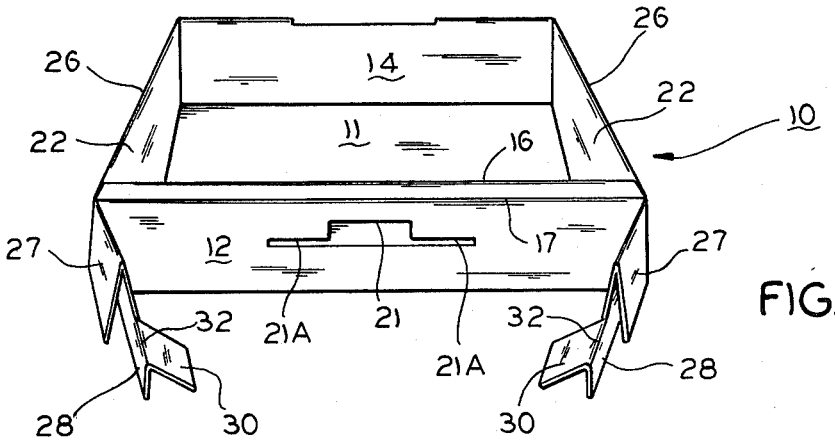
FIG. 2 is a perspective view showing a step in erecting a tray from the blank of FIG. 1.
Figure 3:
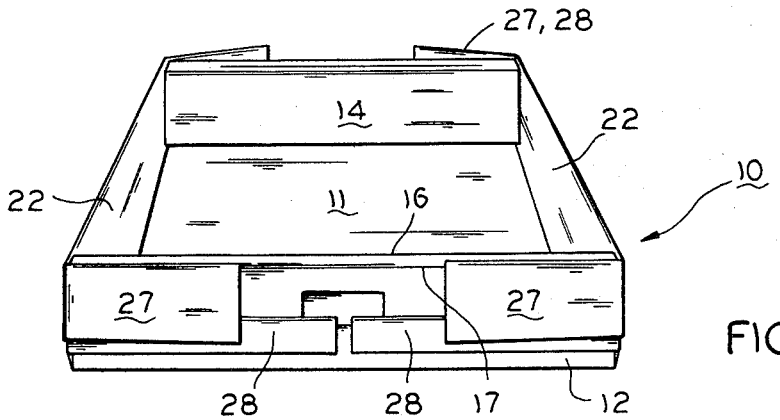
FIG. 3 is a perspective view showing an erected tray.

The tray structure according to the present invention is denoted generally by the reference numeral 10 and is formed from a cut and scored blank of paperboard, or the like, 10A. The tray comprises a rectangular shaped bottom 11 with opposite outer end wall panels 12 foldably connected thereto along the respective fold lines 13.

An inner end wall panel 14 is foldably connected to each outer end wall panel 12 by spaced fold lines 16 and 17 and has a locking tab 18 projecting therefrom. The tab 18 is placed into locking engagement with a slot 19 formed in the bottom 11 adjacent the fold line 13 to provide a double thickness end wall made up of the outer panel 12 and the inner panel 14 arranged in a face-to-face relationship.

The outer panel 12 is provided with a hand receiving opening 21 having slots 21A extending therefrom for a purpose which will become apparent later.

A pair of opposed side wall panels 22 are foldably connected along fold lines 23 to the bottom 11. Each of the side wall panels 22 includes a rim flange 24 foldable with respect to the side panel along a fold line 26.

It should be noted at this time that the end walls and side walls of the tray are trapezoidal in shape, so that upon erection thereof, the sides and ends of the tray 10 slope to provide an improved nesting and stacking feature.

A flap 27 is connected to a flap 28 along a fold line 29 and to an edge of the rim flange 24 along a fold line 27A. A flap 28 is foldably attached to an edge of the side wall panel 22 along said fold line 27A. A locking tab 30 is secured to the flap 28 along a pair of parallel fold lines 31 and 32.

Then the side panel 22 is erected and the flange 24 is folded against the panel 22, the flaps 27 and 28 are likewise folded into a face-to-face engagement along the fold line 29. Thereupon, the folded flaps 27 and 28 are brought into contact with the outer end panel 12. The locking tab 30 is inserted through the slots 21A in the hand receiving openings 21 to lock the side wall to a respective end wall of the tray.

I claim:

1. A tray formed from a cut and scored blank of paperboard or the like comprising:

(a) a rectangular bottom;

(b) a pair of opposed end walls foldably connected to opposite ends of said bottom including an inner and an outer end wall panel foldable with respect to each other and into a locking engagement with said bottom;

(c) a pair of opposed side walls having side panels foldably connected to opposite edges of said bottom and including a rim flange foldable with respect to each side wall panel into a position along the outer face of said side wall panel;

(d) flaps foldably connected to each end of said rim flange and said side wall panel and foldable into position against said end walls;

(e) a hand receiving opening formed in said end walls and including locking slots extending therefrom;

(f) a locking tab hinged to an edge of at least one of said flaps at each of said rim flange and folded against said outer end wall panel and extending into said locking slots to secure said side walls to said end walls.

2. A tray according to claim 1, wherein said side and end walls are trapezoidal in shape.

* * * * *